United States Patent [19]

Reh

[11] 4,451,102

[45] May 29, 1984

[54] ELECTRICAL PLUG

[76] Inventor: Chuan Reh, No. 4-1, La. 460, Shing Min Rd., Nei Hu District, Taipei, Taiwan

[21] Appl. No.: 361,969

[22] Filed: Mar. 25, 1982

[51] Int. Cl.[3] ..... H01R 4/48

[52] U.S. Cl. ..... 339/74 R; 339/196 A

[58] Field of Search ..... 339/74 R, 61 R, 95 R, 339/95 A, 195 A, 196 A

[56] References Cited

U.S. PATENT DOCUMENTS

| | | | |
|---|---|---|---|
| 1,890,484 | 12/1932 | Allemic | 339/74 R |
| 2,245,986 | 6/1941 | Krauss | 339/74 R X |
| 2,411,846 | 12/1946 | Bir | 339/61 R |
| 3,719,919 | 3/1973 | Tibolla | 339/95 A |

FOREIGN PATENT DOCUMENTS

| | | | |
|---|---|---|---|
| 906834 | 2/1946 | France | 339/74 R |
| 616672 | 6/1978 | U.S.S.R. | 339/61 R |

*Primary Examiner*—Z. R. Bilinsky

[57] ABSTRACT

A novel electrical plug comprising two identical members longitudinally combined face-to-face with each other, each member at an inner side comprising four sections including, in sequential order from rear to front end, a support section defining a groove for accommodating a connecting wire, a terminal receiving section having a recessed platform and a central polygonal hole to receive a terminal screw, a fulcrum section forming a pair of semi-circular protrusions spaced apart from each other and a pair of semi-circular recesses at the remainder spaces, and a spring retention section having a platform at a level lower than that of the platform at said terminal receiving section and a central through hole to retain a coil spring which has hooks at both ends extending and fastening at the outer side of both members and thereby combining said members together, and at the front end comprising a conductor integrally formed therein.

7 Claims, 6 Drawing Figures

ELECTRICAL PLUG

The present invention relates to a novel electrical plug.

Conventionally, the electrical plug has various disadvantages. Firstly, the contact between the conductor and the socket to be inserted will readily lose its tightness and results in poor connection, especially after a certain period of use. Secondly, the wire wound around the terminal pin is readily disconnected from said pin due to pulling by an hand as usually done by ordinary person, when taken out of the corresponding socket. Thirdly, in operation of winding and/or replacement of the connecting wire, the plug comprised of two members must be completely dismantled. This is not only troublesome and an expense of time, but also leads readily to loss of parts by accident.

The main object of the present invention is to provide a novel plug which utilizes a spring force to keep and ensure the tightness of contact between the conductor thereof and the socket to be inserted.

Another object is to provide a novel plug in which a polygonal hole is provided to receive the wire terminal screw with a corresponding polygonal washer for enhancing the fixation of the wire.

Further another object is to provide a novel plug in which as soon as two constituting members are turned substantially 90 degrees relative to each other, the wire terminal screws are exposed, thereby winding and/or replacement of wire may be performed without dismantling the members themselves.

The aforementioned objects will be accomplished by this invention providing a novel plug which comprises two identical members longitudinally combined face-to-face with each other, each member at an inner side comprising four sections, namely, in sequential order from rear to front end, a support section defining a groove for accommodating the connecting wire, a terminal receiving section having a recessed platform and a central polygonal hole to receive a terminal screw, a fulcrum section forming a pair of semi-circular protrusions spaced apart from each other and a pair of semi-circular recesses at the remainder spaces, and a spring retention section having a platform at a level lower than that of the platform at the terminal receiving section and a central through hole to retain a coil spring which has hooks at both ends extending and fastening at outer side of both members and thereby combining said members together, and at the front end providing a conductor integrally formed with said member.

The aforementioned and other objects and features of the present invention will be apparent from the following description with reference to the annexed drawings, in which.

Now, referring to FIG. 1, it illustrates only one constituting member of the plug according to the present invention. Another member is identical to that as shown. And the similar parts on said another member will be indicated by the same numerals with a suffix of a.

Figure 4:
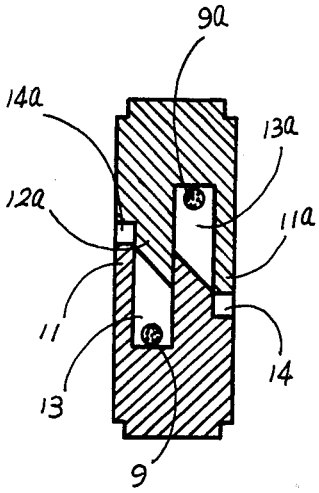
FIG. 4 is a sectional view taken along line IV—IV of FIG. 2.

The member has a particular configuration which may be roughly divided into four sections according to the different contours and functions at the inner side. In sequential order from rear to front end in the longitudinal direction, at first is the support section 1 which has two walls 11 and 12 defining a groove 13 therebetween, and a step 14 at the outside of the inner wall 12. The inner wall 12 at the top is inclined downwardly to the side provided with said step 14, as best shown in FIG. 4.

Second is the terminal receiving section 2 which has a recessed platform 21 and a central polygonal hole 22 which at the top rim 23 is formed with a circular shape for aesthetic appearance and at the bottom a threaded reduced hole 24 is provided for threadable engagement with the terminal screw 6.

Figure 3:
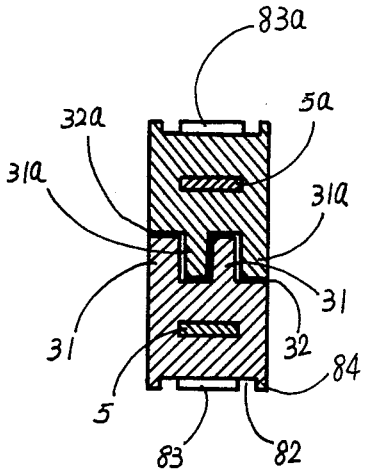
FIG. 3 is a sectional view taken along lline III—III of FIG. 2.

Third is fulcrum section 3 which is formed with a pair of semi-circular protrusions 31,31 spaced apart to with each other and a pair of semi-circular recesses 32,32 at the remainder spaces in such a way that said pair of protrusions 31,31 and said pair of recesses 32,32 are arranged alternatively. And when two identical members are combined face-to-face together, the protrusions 31,31 and recesses 32,32 in one member will be mated with the recesses *32a,'32a* and protrusions *31a,31a* in another member, respectively, as best shown in FIG. 3.

Figure 1:
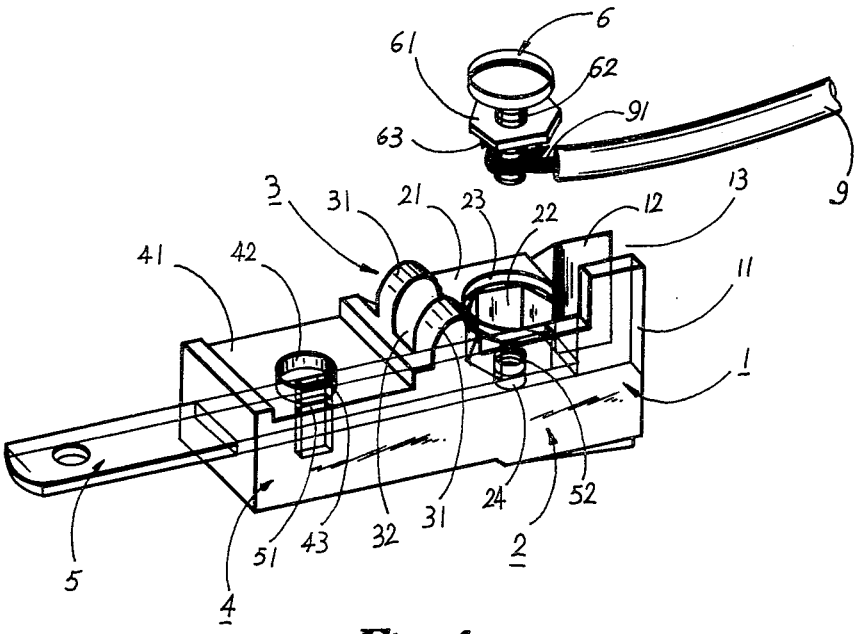
FIG. 1 is a exploded perspective view depicting one consitituting member of the plug according to the present invention.
Figure 2:
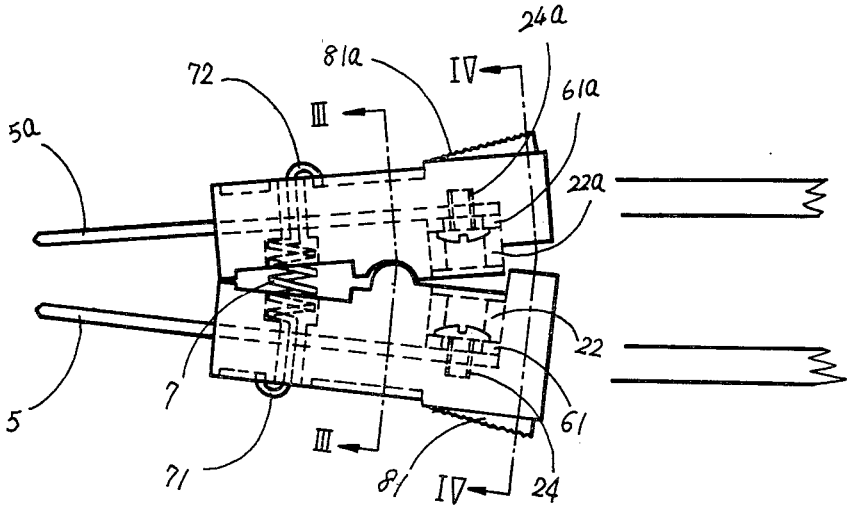
FIG. 2 is a longitudinal elevation depicting two identical members as shown in FIG. 1 which are combined together to form an unitary plug.

Fourth is spring retention section 4 which has a recessed platform 41 at a level lower than that of the platform 21 at the second section 2. A central through hole 42 is provided to receive a coil spring 7 as shown in FIG. 2. Said hole 42 is reduced at a lower portion to become a slot 43 extending through the entire thickness and exposed at the outer side, as seen in to FIG. 5.

The conductor 5 is made of conductive metal and integrally molded with the whole member in such a manner that the conductor 5 is terminated over the reduced hole 24. In addition to the plate shape as shown, the conductor 5 may be formed as rod-like as desired. In either case, the conductor 5 is provided with a slot 51 and hole 52 aligned with slot 43 and hole 24, respectively.

Figure 5:
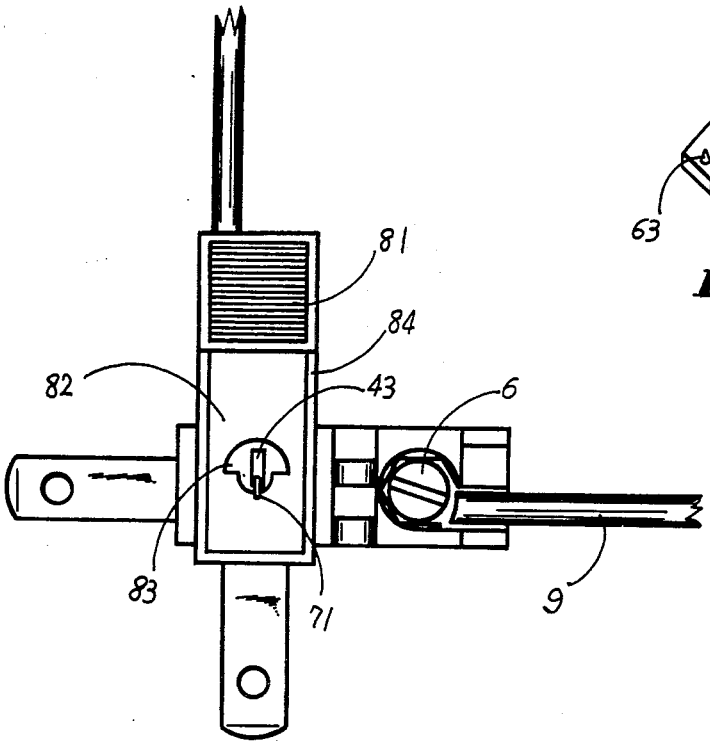
FIG. 5 is a plane view depicting two members are turned 90 degrees relative to each other.

At the outer side of the member, as seen in FIGS. 2 and 5 is formed a striated raised portion 81 to be gripped by fingers of the user for easy operation and a recess 82 in which a land 83 is formed. The level of said land 83 would not exceed the periphery 84 as best shown in FIG. 3. The aforementioned slot 43 is exposed from said land 83.

Figure 6:
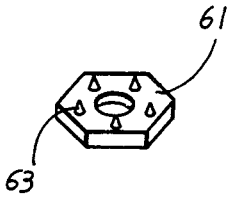
FIG. 6 is a perspective view depicting the underside of the polygonal washer.

In assembling, a polygonal washer 61 having a configuration corresponding to said polygonal hole 22 is engaged on the threaded stem 62 of the screw 6. The term "polygonal" used in this specification including claims is preferably referred but not limited to hexagonal. Then, the bared end 91 of the connecting wire 9 is wound around said stem 62. And the screw 6 is threaded into the position in such a manner that said stem 62 with the male thread is inserted into the hole 24 with the female thread and the washer 61 is snugly fitted in the hole 22 and presses the bared wire 91 tightly. On the underside of the washer 61, a plurality of inverted pyramid teeth 63 is provided, as clearly shown in FIG. 6, to enhance the effect of pressing on said bared wire 91 and provides greater contact area for better conductive efficiency. The wire 9 passes through the groove 13 to the outside. The washer 61 can also prevent said bared wire 91 from being exposed to the hole 22. Further on the upper surface of the washer 61 and the head of the screw 6, an insulating layer is preferably applied.

After two identical members are prepared separately as mentioned above, the coil spring 7 is placed into the hole 42 with one hook end 71 extended out of the slot 43 and fastened over the land 83, as shown in FIG. 5. Then, another member is overlapped at the platform 41 with the corresponding platform of one member in cross manner, as shown in FIG. 5, with another hook end 72 extended out of the similar slot and fastened over the similar land. Two members are thus combined together. Then, one member is slightly raised with respect to the other member and turned substantially 90 degrees to make the protrusions 31*a*,31*a* and recesses 32*a*,32*a* mated with recesses 32,32 and protrusions 31,31, respectively, Hence, the plug is completed as shown in FIG. 2.

Owing to the restoring force of the extensible coil spring 7, the two members are normally convergently inclined and may be pivoted at the protrusions 31,31,31*a*,31*a* and recesses 32,32,32*a*,32*a* as the fulcrum. In use, the user may exert a slight force on the portion 81 to make the two conductors 5 and 5*a* in substantial parallel relationship for readily inserting into the socket (not shown). As soon as the force is released, the conductors 5,5*a* will tightly press on corresponding conductors in said socket by means of the restoring force of the spring 7. Therefore, the positive electrical connection between plug and socket is always ensured.

As soon as the two members are turned 90 degrees relative to each other to the state as shown in FIG. 5, the terminal screw 6 is exposed, then the wire 9 can be connected, disconnected or replaced without it necessary to dismantle the plug.

The aforementioned embodiments serve only for illustrative purposes and by no means to restrict the scope of the present invention. Any modifications can easily be made by those skilled in the art and should be considered within the scope of the attached claims.

What I claim is:

1. An electrical plug comprising two substantially identical members longitudinally connected face-to-face with each other, each member at an inner side comprising four sections including, in sequential order from a rear end to a front end thereof, a support section defining a groove for accommodating a connecting wire, a terminal receiving section having a recessed platform and a central polygonal hole to receive a terminal screw, a fulcrum section forming a pair of semi-circular protrusions spaced apart from each other and a pair of semi-circular recesses at the remainder spaces, and a spring retention section having a platform at a level lower than that of the platform at said terminal receiving section and a central through hole retaining a coil spring which has a hook at both ends extending and fastening at an outer side of both members respectively to connect said members together, and at the front end a conductor integrally formed therein, said members being movable to a position wherein they are disposed substantially 90° with respect to each other, in which position the platforms in the spring retention sections of said members can be placed in contact with each other to facilitate fastening of said hooks of said spring at the outer sides of said members when assembling said members, said members being then movable to a position in which they are longitudinally connected face-to-face to tension said spring.

2. The plug as set forth in claim 1, wherein the terminal screw is provided with a polygonal washer in a configuration complementary to said polygonal hole.

3. The plug as set forth in claim 2, wherein said polygonal washer is hexagonal.

4. The plug as set forth in claim 2, wherein said washer is provided with a plurality of inverted pyramid teeth on an underside thereof.

5. The plug as set forth in claim 2, wherein said washer is applied on an upper surface thereof with an insulating layer.

6. The plug as set orth in claim 1, wherein said terminal screw is applied on an upper surface of the head thereof with an insulating layer.

7. The plug as set forth in claim 1, wherein when the members are in said longitudinally connected face-to-face position the semi-circular protrusions of one member are mated with the semi-circular recesses of the other member, and said platforms in the spring retention sections of said members are out of contact with each other.

* * * * *